US006036139A

United States Patent [19]

Ogg

[11] Patent Number: 6,036,139

[45] **Date of Patent: *Mar. 14, 2000**

[54] DIFFERENTIAL PLY CORE FOR CORE WOUND PAPER PRODUCTS

[75] Inventor: Randy Gene Ogg, Newberry, Fla.

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/735,181

[22] Filed: Oct. 22, 1996

[51] Int. Cl.[7] ..... B65H 75/18

[52] U.S. Cl. ..... 242/610.1; 138/144; 156/188; 156/195; 428/37

[58] Field of Search ..... 242/118.8, 118.32, 242/609, 610.1, 609.4; 156/215, 188, 190, 195; 138/129, 149; 428/34.2, 37; 464/181, 183

[56] References Cited

U.S. PATENT DOCUMENTS

| | | | |
|---|---|---|---|
| 1,920,081 | 7/1933 | John . | |
| 2,035,304 | 3/1936 | Diefenbach | 138/78 |
| 2,623,445 | 12/1952 | Robinson | 93/94 |
| 2,751,936 | 6/1956 | Dunlap et al. | 138/78 |
| 2,755,821 | 7/1956 | Stahl | 138/76 |
| 2,888,043 | 5/1959 | Reid | 138/78 |
| 3,234,970 | 2/1966 | Baker et al. | 138/125 |
| 3,274,905 | 9/1966 | Demsey, Jr. et al. | 93/94 |
| 3,338,270 | 8/1967 | Denenberg | 138/144 |
| 3,421,550 | 1/1969 | Whaley et al. | 138/144 |
| 3,429,522 | 2/1969 | Cunningham et al. | 242/118.32 |
| 3,524,779 | 8/1970 | Masters et al. | 156/190 |
| 3,616,819 | 11/1971 | Dunlap, Jr. et al. | 138/144 |
| 3,620,869 | 11/1971 | Stump et al. | 156/190 |
| 4,026,690 | 5/1977 | McClellan | 65/2 |
| 4,617,022 | 10/1986 | Pigneul et al. | 604/391 |
| 5,027,582 | 7/1991 | Dearwester | 53/399 |
| 5,167,994 | 12/1992 | Paulson | 428/34.2 |
| 5,292,391 | 3/1994 | Wallick . | |
| 5,393,582 | 2/1995 | Wang et al. | 242/118.32 X |
| 5,472,154 | 12/1995 | Qiu et al. | 242/609.4 |
| 5,505,395 | 4/1996 | Qiu et al. | 242/610.1 X |
| 5,545,449 | 8/1996 | Tiedeman . | |
| 5,586,963 | 12/1996 | Lennon et al. . | |
| 5,671,897 | 9/1997 | Ogg et al. | 242/610.1 |

FOREIGN PATENT DOCUMENTS

| | | |
|---|---|---|
| 0 421 400 | 4/1991 | European Pat. Off. . |
| 0 598 372 | 5/1994 | European Pat. Off. . |

*Primary Examiner*—Donald P. Walsh
*Assistant Examiner*—William A. Rivera
*Attorney, Agent, or Firm*—Larry L. Huston; E. Kelly Linman; Jacobus C. Rasser

[57] ABSTRACT

A two-ply core for core wound paper products. The inner ply of the core has more resistance to compression than the outer ply. The outer ply may have more resistance to tension than the inner ply. The two-ply core is suitable for use with core-wound paper products and particularly those which have been diametrically compressed. The core may comprise two plies of differing basis weights, wherein the inner ply has a greater basis weight than the outer ply.

11 Claims, 1 Drawing Sheet

DIFFERENTIAL PLY CORE FOR CORE WOUND PAPER PRODUCTS

FIELD OF THE INVENTION

This invention relates to cores for core wound paper products, such as bath tissue and paper towels, and more particularly to cores having two plies.

BACKGROUND OF THE INVENTION

Core wound paper products are in constant use in daily life. Particularly, bath tissue and paper towels have become a staple in home and industry. Such products usually comprise a roll of a paper product spirally wrapped around a hollow core.

The hollow cores are typically made on a coremaking line and comprise inner and outer plies of linerboard superimposed in face-to-face relationship. Each ply of the linerboard is supplied to a coremaking mandril from a spool of raw material. When the two plies are fed to the coremaking mandril, they are typically helically wrapped in the same direction. During wrapping, the plies are adhered throughout to maintain the desired cylindrical configuration.

Typically, the two plies are adhered together in face-to-face relationship with a full coverage of adhesive at the interface between the inner and outer plies. Full adhesive coverage is preferred to minimize occurrences of core failures due to adhesive cracking or breaking. The adhesive is conventionally applied to the interface between the plies, particularly the outer face of the inner ply during manufacture.

Typically, the two plies are identical. Each ply is made from linerboard having the same basis weight and thickness. Basis weights typically used for cores used in consumer products, such as bath tissue and paper toweling,, typically range from 26 to 46 pounds per 1,000 square feet, with a 30 or 38 pound basis weight per 1,000 square feet being a common choice.

The two plies provide crush resistance for the cores during manufacture, particularly when the cores are horizontally stacked in a converting bin, prior to being wrapped with the paper product. The cores at the bottom of the converting bin must resist being crushed by the cores above while awaiting processing. If a core does not have sufficient horizontal crush resistance, it will either be crushed, blocking the cores from dumping into the converting line or will jam while in the line. Either occurrence causes the converting line to incur a shutdown to clear the jam. Of course, the crushed cores must be discarded after they are cleared from the jam or from the converting bin—further increasing the downtime and associated expense. Such horizontal crushing forces severely test the resistance of the two plies of the core to diametrically opposed forces which are unintentionally applied.

However, the diametrically opposed forces can be intentionally applied to the core and/or the core wound paper as well. For example, one improvement to core wound paper products is illustrated in commonly assigned U.S. Pat. No. 5,027,582 issued Jul. 2, 1991 to Dearwester which shows a core wound paper product compacted by diametrical compression. The core is flattened and packaged for shipment and sale. At the point of use, the consumer rerounds the core by recompressing in the direction of the diametrical elongation which occurs due to the prior flattening operation.

If the two plies of the core have insufficient strength, rerounding will not properly occur. The core will either invert, a phenomenon which occurs when the two opposing halves of the core do not separate from one another but instead move together in the same direction, or else it will be necessary to insert a finger or spindle into the core to effect rerounding. Either occurrence is a highly undesirable nuisance for the user.

Upon examination of the intentionally or unintentionally applied diametrically compressive forces to the core, it becomes apparent that the two plies serve different purposes. The inner ply becomes tensioned while the outer ply is placed in compression. The tensile and compressive loadings occur within the circumferential plane of the respective plies. If the tensile strength of the inner ply, the compressive strength of the outer ply, or the combination thereof is insufficient to withstand the applied loadings, the core will either crush prematurely or not properly reround if diametrically compressed.

Furthermore, if the plies are not properly joined together in face-to-face relationship, intra-ply creep will occur. Intra-ply creep is the phenomenon of one ply moving relative to the other ply. The movement is not in a rotational sense, but rather occurs on a more localized basis as either ply creeps. Generally, the inner ply functions as an anvil against which the outer ply is joined. The inner ply resists the hoop forces caused by diametrical compression particularly at the vertexes of the compressed core.

Furthermore, despite the continuing efforts to minimize material usage, the present state of the art most frequently utilizes cores having two identical plies of the same basis weight. The lower limit of the basis weight is constrained by the application of forces, including but not limited to the aforementioned diametrical compressive forces, which occur during the life of the core-wound paper product. Generally, it is believed aggregate basis weight of the two plies of a typical current core cannot be significantly further reduced without an undue number of premature core failures occurring. A typical prior art core utilizes two plies, each ply having identical basis weights of about 42 pounds per 1,000 square feet.

This constraint against reducing core ply basis weight is unfortunate. Any reduction in the basis weight of the core ply provides several advantages. For example, as the basis weight of either ply is reduced and the associated material usage decreases, the cost to the consumer of the core-wound paper product decreases. Furthermore, less material is needed in manufacture - conserving precious natural resources. Finally, upon disposal, lower basis weight materials impart less volume to landfills.

To date, there have been no attempts in the art to directly address the different functions (resistance to tension, resistance to compression) of the respective inner and outer plies. Nor have there been any attempts in the art to directly address the problems of intra-ply creep.

One attempt in the art discloses a core having an inner ply consisting of very inexpensive grades of paper which function as filler while the outer ply is a high grade paper, such as good quality Kraft. In this attempt the outer ply is relatively thin to provide a smooth outer finished surface. This attempt suffers from the drawback that two different grades of material must be utilized, doubling logistics and inventory problems. Different materials would have different thermal expansion rates. This changes the balance of forces between the plies following temperature changes, and may lead to premature failure when loaded.

Another attempt in the art utilizes a laminate of paper and plastic frictionally held together. This attempt in the art is said to be stress-releasing and hence does nothing to prevent the intra-ply creep problem. Yet another attempt in the art discloses a three-ply core. In this attempt the inner and outer plies are kraft paper while the central ply is a vapor barrier. The vapor barrier may be a polyethylene sheet or a wax or asphalt impregnated paper, which allows intra-ply creep to occur. Illustrative of these prior art attempts are U.S. Pat. No. 2,751,936 issued Jun. 26, 1956 to Dunlap et al.; U.S. Pat. No. 2,755,821 issued Jul. 24, 1956 to Stahl; and U.S. Pat. No. 5,167,994 issued Dec. 1, 1992 to Paulson.

Accordingly, it is an object of this invention to provide a two-ply core which optimizes the strength and usage of both plies. It is further an object of this invention to reduce the total material costs of this core. Furthermore, it is an object of this invention to economize the usage of cellulosic fibrous materials in a core for corewound paper products.

SUMMARY OF THE INVENTION

The invention comprises a two-ply core for core-wound paper products. The core has an inner ply and an outer ply joined together in face-to-face relationship. The inner ply has more resistance to compression than the outer ply. Moreover, the outer ply may have more resistance to tension than the inner ply.

In a preferred embodiment, the inner and outer plies are made from similar or identical materials. However, the inner ply has a greater basis weight than the outer ply. This arrangement may be accomplished by providing an inner ply having greater thickness than the outer ply.

BRIEF DESCRIPTION OF THE DRAWINGS

While the Specification concludes with claims particularly pointing out and distinctly claiming the present invention, it is believed the same will be better understood from the following description taken in conjunction with the accompanying drawings in which like parts are given the same reference numeral.

DETAILED DESCRIPTION OF THE INVENTION

Figure 1:
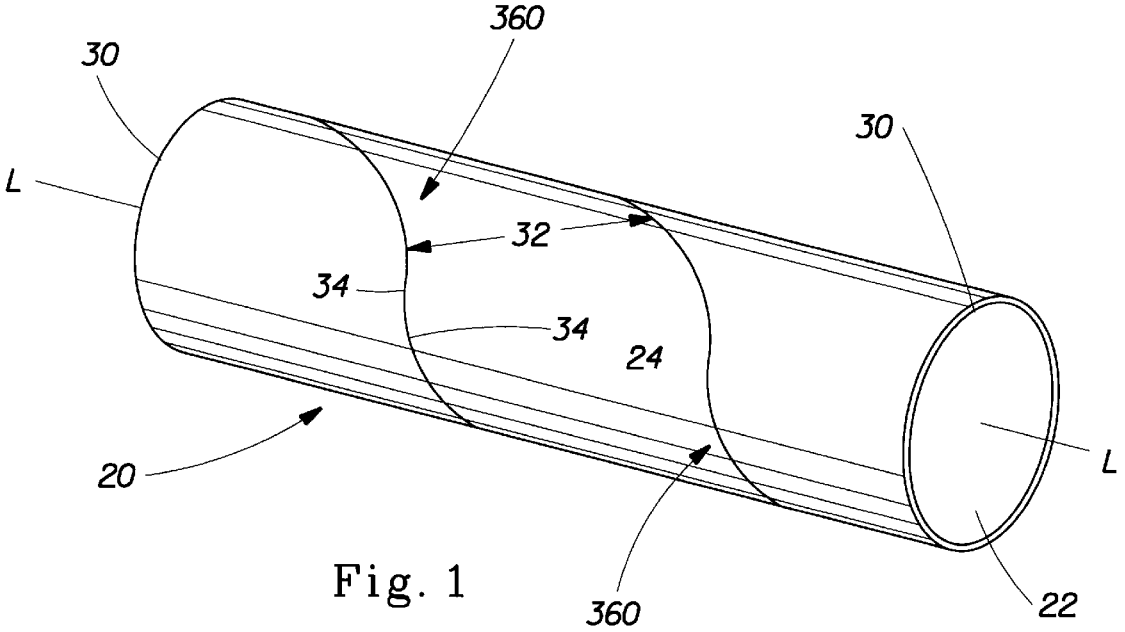
FIG. 1 is a perspective view of a core according to the present invention.
Figure 2:
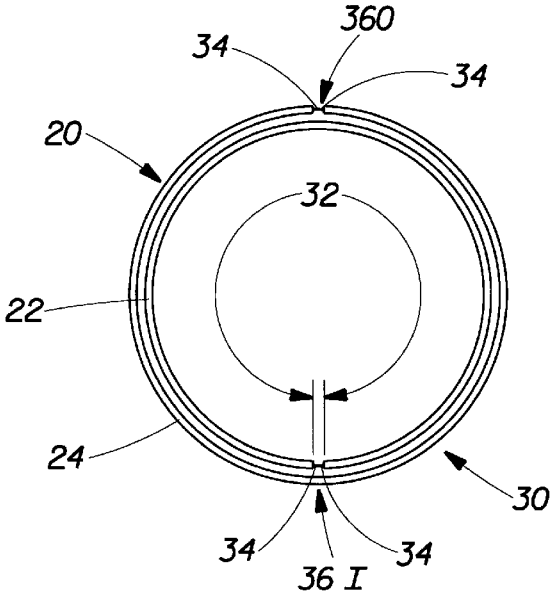
FIG. 2 is an end view of the core of FIG. 1.

Referring to FIGS. 1 and 2, a core 20 according to the present invention comprises an inner ply 22 and an outer ply 24 joined in face-to-face relationship to form a hollow core having two opposed ends 30. The core 20 is generally cylindrical, i.e., the cross section is round if not circular. The ends 30 of the core 20 preferably, not necessarily, define planes perpendicular the longitudinal axis L-L. It is recognized deviations from perfect cylindricality are functional and acceptable.

The plies 22, 24 are spiral wound. As used herein spiral windings include volute, convolute, and helical arrangements. Alternatively, the plies 22, 24 may be constructed so that the seams 36I, 36O are parallel to the longitudinal axis L-L, but are preferably wrapped in a helix around the longitudinal axis L-L.

Each ply 22, 24 has a particular width 32 defined by two edges 34. The edges 34 of the inner ply 22 and outer ply 24 butt up to one another to form seams 36I, 36O therebetween on the inner and outer plies 22, 24 respectively. The inner ply 22 is oriented towards a central longitudinal axis L-L of the core 20. The outer ply 24 is oriented away from the longitudinal axis L-L of the core 20 and contacts the paper product when it is wound around the core 20. As used herein "longitudinal" refers to the direction parallel the longitudinal axis L-L.

When bath tissue is wound on the core 20, the resulting core wound paper product of bath tissue typically has a diameter of about 4.00 to 5.00 inches and a length of about 4.50 inches between the ends 30. If a core 20 embodying the present invention is used for paper towels, the core wound paper product of paper towels typically has a diameter of about 4.00 to 6.25 inches and a length of about 11.0 inches for the embodiments described herein.

The core 20 may be made of two plies 22, 24 of a paper linerboard having any suitable combination of cellulosic fibers such as bleached krafts, sulfites, hardwoods, softwoods, and recycled fibers. The core 20 should exhibit uniform strength without weak spots. Preferably, the core 20 is not calendared, so that it is relatively stiff and retains adhesive deposited thereon. The core 20 should have a mullen strength of at least 60 and preferably at least 70 as measured according to ASTM Test Method D2529. The core 20 may have a thickness of at least about 0.020 inches, and preferably has a thickness of at least about 0.028 inches. The core 20 should be free of objectionable odors, impurities or contaminants which may cause irritation to the skin.

The plies 22, 24 may be made of paper linerboard having a basis weight of about 24 to 42 pounds per 1,000 square feet, although plies 22, 24 having a basis weight as high as 47 pounds per 1,000 square feet have been found to work well in the present invention. For the embodiments described herein, the core 20 should have a cross machine direction ring crush strength of at least about 50 pounds per inch, and preferably at least about 60 pounds per inch as measured by TAPPI Standard T818 OM-87. Suitable linerboard is available as Natural Tube stock from the Menominee Company, of Menominee Falls, Mich., a subsidiary of Bell Packaging Corporation.

The two plies 22, 24 may be wrapped at an angle of about 31 to about 37 degrees, preferably about 34 degrees from the longitudinal direction. The inner and outer seams 36I, 36O are typically offset from each other 180 degrees, as it is believed this configuration maximizes strength due to distributing the weak regions of the core 20 as far apart as possible. To maintain the face-to-face relationship of the inner and outer plies 22, 24, they may be adhered together with starch based dextron adhesive, such as model number 13-1622 available from the National Starch & Chemical Company of Bridgewater, N.J. Generally a full coverage of adhesive at the interface between the inner and outer plies 22, 24 is preferred to minimize occurrences of core 20 failures due to the adhesive cracking or breaking. It is important that the plies 22, 24 be adhesively joined at the overlap to provide strength. The adhesive is conventionally applied to the inner face of the outer ply 24 because the outside of each ply 22, 24 typically passes over a tracking bar.

The plies of the core according to the present invention are securely joined to minimize, and preferably eliminate creep. Plies are considered to be "securely" joined when intra-ply creep does not occur in normal handling, transportation, warehousing and ultimate usage of the core-wound paper products following manufacture of the core.

The two plies are not, however, equal in resistance to loads applied intentionally or unintentionally. The inner ply 22 has more resistance to compression than the outer ply 24. Furthermore, it is desirable that the outer ply 24 provide it with more resistance to tension than is present on the inner ply 22.

The relatively greater resistance to tension of the outer ply 24 of the core 20 may be provided in several manners. One manner is to prestress the inner ply 22. As used herein, a prestress refers to a load applied to a core 20 during manufacture and which remains while the core 20 is at rest and not loaded. The prestress may be applied to the inner ply 22 by elastic. Elastic, such as a sheet or, preferably a linear elastic strand 48 may be prophetically wound about the inner circumference of the inner ply 22 of the core 20. Prophetically the linear elastic strand 48 may be wound in a spiral pattern or, alternatively, may be wound in a completely circumferential pattern. The linear elastic strand 48 is stretched, then adhered in place, so that a compressive hoop stress is applied to the inner ply 22.

The relatively greater resistance to compression of the inner ply 22 may be also provided by prestressing. To prestress the inner ply 22, a member 50 may be joined to it, preferably on the outer circumference of the inner ply 22, which member expands in the presence of ambient humidity. Prophetically, a dry, highly creped paper would suffice. The dry, highly creped paper is tightly wound around the outer circumference of the outer ply 24 and adhesively joined thereto. This crepe paper may again be wound in either a spiral pattern or a completely circumferential pattern.

Prophetically, the resistance to compression and resistance to tension of the plies can be adjusted by changing the bias of the wrap, i.e., by wrapping the inner 22 ply and outer ply 24 at various angles relative to the longitudinal axis.

Preferably, the two plies 22, 24 are made from material which is similar, and more preferably the two plies 22, 24 are made from identical material. Materials are considered "identical" which are fungibly interchangeable and differ only according to extensive properties such as thickness and basis weight.

The core 20 according to the present invention having one ply, particularly the inner ply 22, with more resistance to compression than the outer ply 24, may be achieved by having the plies 22, 24 made of identical material. In this embodiment the inner ply 22 is thicker than the outer ply 24. The inner ply 22 may be made thicker by providing material for the inner ply 22 having a greater basis weight than the material for the outer ply 24. Particularly, according to the present invention, the material used for the inner ply 22 may be linerboard having a basis weight of about 30 to 42 pounds per 1,000 square feet.

Conversely, the outer ply 24 may have a lesser thickness and lesser basis weight than the inner ply 22. The outer ply 24 may be made of linerboard having a basis weight of 26 to 38 pounds per 1,000 square feet.

Basis weight is measured according to TAPPI Standard T410 DM-88. Thickness is measured according to TAPPI Standard T411.

Resistance to compression is measured by the following test. A single ply 22, 24 of the material to be tested is conditioned for at least two hours according to TAPPI Standards at 73±2 degrees Fahrenheit, 50±2 percent relative humidity. A rectangular sample is cut from the material using a JDC or equivalent cutter. The resulting rectangle has a dimension of 25.4 millimeters in the cross-machine direction and 66.0 millimeters in the machine direction.

The sample is formed into a cylinder having the machine direction circumferentially oriented and the cross-machine direction parallel the axis of the cylinder. The cylinder has a nominal diameter of about 20 millimeters, with an overlap at the ends of 3.0 to 3.5 millimeters. A piece of tape having a width of about 0.75 inches wide parallel the cross-machine direction and one about 0.5 inches parallel the machine direction is carefully placed on the sample and centered both axially and circumferentially on the overlap. Scotch Brand 310 or equivalent tape, that does not interfere with the test, is sufficient.

The sample is placed in an Instron machine having the crossheads separated 1.250 inches allowing a clearance of 0.250 inches between the sample and the upper crosshead. An Instron 4502 or equivalent tensile machine, having a one hundred Newton load cell is suitable. The sample is centered on the crosshead with the axis of the cylinder parallel to the direction of travel of the moving crosshead. The crossheads are set to travel in the compression direction 0.2875 inches. This distance consumes the initial 0.25 inch clearance between the sample and the crossheads, then compresses the sample approximately 0.0375 inches. The crosshead speed should be 20 inches per minute. The peak force reading in grams from compressing the sample is recorded.

A core 20 according to the present invention has an inner ply 22 with a resistance to compression of at least about 7,000 grams, and more preferably at least 8,000 grams. Furthermore, preferably the inner ply 22 has a resistance to compression that is at least 4,000 grams greater, and preferably at least 5,000 grams greater, than that of the outer ply 24.

An inner ply 22 having a suitable resistance to compression according to the present invention may be made of Natural Tube stock type linerboard, or equivalent, and have a basis weight of at least 38 pounds per 1,000 square feet, and preferably a basis weight of at least 42 pounds per 1,000 square feet, although prophetically a basis weight of about 35 pounds per 1,000 square feet would be adequate. The relationship between basis weight and resistance to compression for Natural Tube stock linerboard from the aforementioned Menominee Company is illustrated in Table I below.

In Table I below, the first column represents the basis weight in pounds per 1,000 square feet of the material. The second column represents the resistance in compression of the sample measured as described above. Each entry in the second column represents an average of 100 different samples, ten samples having been taken from ten different lots. The third column gives the standard deviations of the averages in the second column.

TABLE I

| Basis Weight (Pounds per 1,000 square feet) | Average Resistance to Compression (grams) | Standard Deviation |
|---|---|---|
| 26 | 500 | 60 |
| 30 | 500 | 100 |
| 38 | 7,300 | 1,200 |
| 42 | 9,000 | 1,300 |

Table I demonstrates an almost step change in resistance to compression as the basis weight of the ply 22, 24 increases from 30 to 38 pounds per 3,000 square feet. Thus, it can be seen, an inner ply 22 according to the present invention and made of conventional materials preferably has the basis weight specified above.

As noted above, the outer ply 24 preferably has more resistance to tension than the inner ply 22. Resistance to tension is measured according to the following test.

A single ply 22, 24 of the material to be tested is conditioned for at least two hours in a room controlled to TAPPI Standards, 73±2 degrees Fahrenheit, 50±2 percent relative humidity. A dogbone sample is then cut from the ply 22, 24 using any JDC cutter or equivalent. The dogbone sample has a gage length of 2.5 inches and a width of 1.0 inches. The sample is placed in an Instron 4502 or equivalent tensile machine. For lower basis weight samples (such as 26 or 30 pounds per 1,000 square feet), light duty jaws and a one hundred Newton load cell are sufficient. Higher basis weight samples (such as 38 or 42 pounds per 1,000 square feet), work better with heavy duty jaws and a 1,000 Newton load cell. Samples of intermediate basis weight can be measured using either light or heavy duty jaws and a load cell judged appropriate by one skilled in the art.

The sample is inserted in the jaws. The crosshead is set to travel in the extension direction 0.0375 inches at a rate of one inch per minute. The peak reading in grams is then recorded, as the resistance to tension of that ply 22, 24.

The resistance to tension of Natural Tube stock linerboard from the aforementioned Menominee Company, having four different basis weights is given in Table II below. Following the format of Table I, the first column represents the basis weights of the samples in pounds per 1,000 square feet of material. The second column gives the average resistance to tension measured as described above. Each entry in the second column represents an average of 100 samples, ten samples having been taken from ten different lots. The third column gives the standard deviations of the averages of the second column.

TABLE II

| Basis Weight (Pounds per 1,000 square feet) | Average Resistance to Tension (grams) | Standard Deviation |
|---|---|---|
| 26 | 8,490 | 1,130 |
| 30 | 9,070 | 1,060 |
| 38 | 26,560 | 1,150 |
| 42 | 25,800 | 1,320 |

The difference in average resistance to tension between the 38 and 42 pound basis weight samples is not statistically significant, given the relatively large standard deviations. Preferably, the outer ply 24 has a resistance to tension of less than 20,000 grams, and more preferably less than 10,000 grams. This may be accomplished by providing an outer ply 24 having a basis weight of not more than 30 pounds, and preferably not more than 26 pounds per 1,000 square feet.

A particularly preferred embodiment according to the present invention utilizes a two ply core 20 having an inner ply 22 with a basis weight of 38 pounds per 1,000 square feet and an outer ply 24 with a basis weight of 30 pounds per 1,000 square feet.

This embodiment provides two plies 22, 24 having a total basis weight of 68 pounds per 1,000 square feet, a 19 percent reduction in material over a typical prior art core 20 having identical inner and outer plies, each with a basis weight of 42 pounds per 1,000 square feet for a combined basis weight of 84 pounds per 1,000 square feet. The core 20 according to the present invention unexpectedly provides a suitable core 20 with less material.

It will be apparent that other benefits and advantages are possible with the claimed invention, and that combinations and permutations of the foregoing are also possible. For example, materials which are relatively stiffer may be used on the inner ply 22, in conjunction with prestressing of either the inner ply 22, the outer ply 24, or both. All of the foregoing are encompassed by the appended claims.

What is claimed is:

1. A core for spirally wrapping paper products therearound, said core comprising an inner ply and an outer ply securely joined in face-to-face relationship, said inner ply having more resistance to compression than said outer ply, said core being prestressed.

2. A core according to claim 1 further comprising an elastic member.

3. A core according to claim 2 wherein said elastic member is a linear strand.

4. A core according to claim 3 having an inner surface and an outer surface, said linear strand backing applied to said inner surface of said inner ply.

5. A core according to claim 1 having an inner surface and an outer surface, said core being prestressed by a member joined to said outer surface of said outer ply.

6. A core according to claim 5, wherein said member expands in the presence of ambient humidity.

7. A core according to claim 1, wherein said inner ply and outer ply have different basis weights.

8. A core according to claim 7, wherein said inner ply has a greater basis weight than said outer ply.

9. A core for spirally wrapping paper products therearound, said core comprising an inner ply and an outer ply securely joined together in face-to-face relationship, said inner ply and said outer ply each having a basis weight, said inner ply and said outer ply being made of identical materials, but differing in the basis weights of said identical materials, said inner ply having a greater basis weight than said outer ply.

10. A core according to claim 9, wherein said inner ply and said outer ply comprise liner board.

11. A core according to claim 10, wherein said inner ply and said outer ply are adhesively joined together.

* * * * *